US011772153B2

(12) United States Patent
Wen et al.

(10) Patent No.: US 11,772,153 B2
(45) Date of Patent: Oct. 3, 2023

(54) ELECTROMAGNETIC STIRRING DEVICE AND METHOD FOR SECONDARY COOLING ZONE DURING SLAB CONTINUOUS CASTING

(71) Applicant: BAOSHAN IRON & STEEL CO., LTD., Shanghai (CN)

(72) Inventors: Hongquan Wen, Shanghai (CN); Yueming Zhou, Shanghai (CN); Cunyou Wu, Shanghai (CN); Chao Hu, Shanghai (CN); Xiaoli Jin, Shanghai (CN); Xianjiu Zhao, Shanghai (CN); Chunfeng Wang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 56 days.

(21) Appl. No.: 17/617,663

(22) PCT Filed: Jun. 10, 2020

(86) PCT No.: PCT/CN2020/095358

§ 371 (c)(1),
(2) Date: Dec. 9, 2021

(87) PCT Pub. No.: WO2020/249004

PCT Pub. Date: Dec. 17, 2020

(65) Prior Publication Data

US 2022/0305549 A1 Sep. 29, 2022

(30) Foreign Application Priority Data

Jun. 12, 2019 (CN) ..... 201910504269.6

(51) Int. Cl.
*B22D 11/115* (2006.01)
*B22D 11/22* (2006.01)
(Continued)

(52) U.S. Cl.
CPC ..... *B22D 11/115* (2013.01); *B22D 11/122* (2013.01); *B22D 11/1246* (2013.01); *B22D 11/225* (2013.01)

(58) Field of Classification Search
CPC ..... B22D 11/115; B22D 11/12; B22D 11/122; B22D 11/124; B22D 11/1246; B22D 11/22; B22D 11/225
(Continued)

(56) References Cited

U.S. PATENT DOCUMENTS 4,016,926 A 4/1977 Yamada et al.
4,741,383 A 5/1988 Hull et al.

FOREIGN PATENT DOCUMENTS

CN 201519749 U 7/2010
CN 202185569 U 4/2012
(Continued)

OTHER PUBLICATIONS

The JP Office Action dated Sep. 13 for 2021-573545.
(Continued)

*Primary Examiner* — Kevin P Kerns
(74) *Attorney, Agent, or Firm* — Lei Fang, Esq.; Smith Tempel Blaha LLC

(57) ABSTRACT

An electromagnetic stirring device and a method for a secondary cooling zone during slab continuous casting. The device has a main body, an opening adjustment assembly, and a secondary cooling assembly. The main body has a protection housing (3), a phase sequence control assembly, an iron core (4) and an electromagnetic coil (5) for carrying out variable-direction electromagnetic stirring on a molten steel by a three-phase current phase sequence transformation. The opening adjustment assembly has an air cylinder (7), a fixed base (8), a movable joint shaft (12) and a silicon steel sheet group insert (13) for adjusting online opening
(Continued)

degree of the closed annular iron core by a movable joint structure. The secondary cooling assembly has a cooling water inlet (9) and a cooling water nozzle (10) for cooling the electromagnetic coil and spraying cooling water to a surface of a cast slab (1).

10 Claims, 4 Drawing Sheets

(51) Int. Cl.
*B22D 11/124* (2006.01)
*B22D 11/12* (2006.01)

(58) Field of Classification Search
USPC ..... 164/466, 467, 468, 502, 503, 504, 147.1
See application file for complete search history.

(56) References Cited

FOREIGN PATENT DOCUMENTS

| | | | |
|---|---|---|---|
| CN | 202571213 | U | 12/2012 |
| CN | 103182495 | A | 7/2013 |
| CN | 104107891 | A | 10/2014 |
| CN | 104209499 | A | 12/2014 |
| CN | 105728679 | A | 7/2016 |
| CN | 105935751 | A | 9/2016 |
| CN | 106475537 | A | 3/2017 |
| CN | 108723316 | A | 11/2018 |
| CN | 208929149 | U | 6/2019 |
| EP | 0019118 | A | 11/1980 |
| JP | 1-044251 | | 2/1989 |
| JP | H11-320052 | A | 11/1999 |
| JP | 2009066651 | A | 4/2009 |
| JP | 2010214392 | A | 9/2010 |
| JP | 2018103198 | A | 7/2018 |
| JP | 2018518369 | A | 7/2018 |

OTHER PUBLICATIONS

The extended EP search report dated Apr. 22, 2022.
International Search Report for PCT/CN2020/095358, dated Sep. 9, 2020.
International Written Opinion for PCT/CN2020/095358, dated Sep. 9, 2020.

ELECTROMAGNETIC STIRRING DEVICE AND METHOD FOR SECONDARY COOLING ZONE DURING SLAB CONTINUOUS CASTING

CROSS-REFERENCE TO RELATED APPLICATIONS

This application is a 371 U.S. National Phase of PCT International Application No. PCT/CN2020/095358 filed on Jun. 10, 2020, which claims benefit and priority to Chinese patent application No. CN 201910504269.6 filed on Jun. 12, 2019, the content of both are incorporated by reference herein in their entireties.

TECHNICAL FIELD

The present disclosure relates to an electromagnetic stirring device and method for the technical field of continuous casting, and especially relates to an electromagnetic stirring device and method for the secondary cooling zone of slab continuous casting.

BACKGROUND

In the continuous casting technology, equiaxed crystal ratio is an essential parameter for the quality and performance property of the casting slab, and is generally kept at a level of 20% to 40%. A slab with an excessively low equiaxed crystal ratio is subject to inter-crystal cracking during the solidification of the slab and the subsequent rolling treatment. Furthermore, the solidification of the steel mainly results in the formation of columnar crystal usually accompanied with severe center component segregation, which is significantly detrimental to the improvement in the internal quality and performance properties of the slab. It has been proved by practice that the continuous casting of high-carbon steel, silicon steel, stainless steel, etc. usually need electromagnetic stirring at the secondary cooling zone or liquid core soft reduction at the final stage of the solidification to interrupt the solidification and growth of the internal columnar crystal in the slab, increase the crystal nucleus number at the solid-liquid interface frontier, thus achieving the effects of nucleation promotion, crystal grain refining, segregation inhibition and the like.

Presently the typical electromagnetic stirring technology for the secondary cooling zone of continuous casting (S-EMS) include: (a) counter-electrode stirring, such as the inserted counter-electrode electromagnetic stirring device disclosed by U.S. Pat. No. 4,706,735A; (b) roller-type stirring, such as the roller-type electromagnetic stirring device disclosed by US2009183851A1 and the electromagnetic stirring roller disclosed by the Chinese patent ZL200710085940.5; and (c) box stirring, such as the linear electromagnetic stirring device disclosed by JP2006289476A. All of the stirring devices indicated above have an internal structure consisting of coil winding group and laminated iron core of silicon steel sheets. The stirring device is arranged crosswise along the width-side of the casting slab, between or downstream the segmented rollers of the segment of the casting machine. Through the proximity effect of the electromagnetic field, traveling wave electromagnetic stirring force is inductively produced along a specific direction within the casting slab, thus driving the molten steel in the slab to flow orientedly. Due to the existence of the segmented rollers, which generally have a roller diameter of about 150 mm, at both sides of the casting slab, there is generally a large distance between the stirring electromagnetic field generation device and the casting slab as measured within the secondary cooling zone. For example, the distance between the box stirring device and the casting slab is generally 200 mm or more, and the linear stirring device exhibits magnetic field leakage at both ends of the iron core, hence these devices can only achieve inferior electromagnetic stirring efficiency and limited actual effect. With regard to the roller stirring device, in spite of the contact between the stirring roller and the casting slab, the stirring magnetic field strength within the slab is not very high due to the limited inner cavity dimension of the stirring roller and the shielding effect of the roller to the magnetic field.

Recently thin slab continuous casting and continuous rolling technologies (e.g. CSP, ESP, etc.) have been newly developed. These technologies have a small slab thickness of 60 mm to 90 mm and a higher withdrawal speed of 4 to 6 m/min, and are distinct from the ordinary continuous casting technology in more significant columnar crystal and lower equiaxed crystal ratio. These new technologies have brought about dramatically increased demand on the electromagnetic stirring capacity of the secondary cooling zone, hence it is desirable to develop a unique and efficient electromagnetic stirring suitable for the secondary cooling zone so as to ensure the quality of the casting slab.

SUMMARY

The present disclosure aims to provide an electromagnetic stirring device and an electromagnetic stirring method for the secondary cooling zone of slab continuous casting which can achieve the advantages of reduced magnetic field loss, high stirring efficiency. The opening degree of the stirring device can be adjusted online, the stirring direction can be reversed alternatively, and the quality and performance property of the continuous casting slab can be effectively improved.

The present disclosure can be embodied via the following technical solutions.

An electromagnetic stirring device for the secondary cooling zone of slab continuous casting, comprises a main body of the electromagnetic stirring device, an opening adjustment assembly and a secondary cooling assembly; the main body of the electromagnetic stirring device comprises a protective shell, a phase sequence control assembly, as well as an iron core and an electromagnetic coil disposed within the protective shell, the opening adjustment assembly comprises a cylinder, a fixing base, a movable joint shaft and multiple pieces of silicon steel sheet group inserts; the multiple pieces of silicon steel sheet group inserts are sequentially connected by the movable joint shaft to form movable joints so that the silicon steel sheet group inserts are rotatable around the movable joint shaft, and the multiple movable joints are connected with the iron core to form a closed annular structure; an electromagnetic coil is wound on the iron core, and the electromagnetic coil is operated by the phase sequence control assembly for generating an alternating magnetic field in the closed annular structure, and a casting slab passes through the alternating magnetic field in the closed annular structure; the cylinder, which is fixedly installed on the outside of the main body of the electromagnetic stirring device through the fixing base, has a piston end connected with the main body of the electromagnetic stirring device and thus providing driven force for the opening and closing of the movable joint; the secondary cooling assembly comprises a cooling water inlet disposed at an end outside the protective shell and multiple cooling water nozzles spaced apart from each other and disposed at an end inside the protective shell and facing the casting slab, cooling water is transmitted through the cooling water inlet into the protective shell so that the electromagnetic coil and the iron core are completely immersed therein, and the cooling water is then sprayed onto the surface of the casting slab through the multiple cooling water nozzles.

The main body of the electromagnetic stirring device is subjected to a stirring current frequency f1 of 2 Hz to 15 Hz.

The phase sequence control assembly comprises a water-cooled cable, an alternating phase conversion circuit, a fuse and a disconnecting switch; the water-cooled cable comprises a first stirring current inlet line, a second stirring current inlet line and a third stirring current inlet line which are connected to an external three-phase power supply at one end and are connected to the electromagnetic coil via the disconnecting switch, the fuse and through the alternating phase conversion circuit at the other end.

The alternating phase conversion circuit comprises a first contactor, a second contactor, an alternating voltage, a transformer, a first diode, a second diode and a resistor, wherein the alternating voltage is connected to the primary of the transformer, the anodes of the first diode and the second diode are respectively connected to the secondary output terminal of the transformer, the cathode of the first diode is connected to the secondary input terminal of the transformer through the first contactor, and the cathode of the second diode is connected to the secondary input terminal of the transformer through the second contactor and the resistor; the first contactor and the second contactor are connected to the electromagnetic coil, wherein the phase sequence by which the first contactor is connected to the electromagnetic coil is reversed to the phase sequence by which the second contactor is connected to the electromagnetic coil, and the on-off of the first contactor and the second contactor are respectively controlled by the alternating phase conversion circuit.

The alternating voltage has a frequency of 0.1 Hz to 1 Hz.

The phase sequence control assembly further comprises a thermal relay through which the first contactor and the second contactor are respectively connected to the electromagnetic coil.

The protective shell comprises a tooth head end concaved inwardly at both sides to form a cambered structure, wherein the tooth head end of the protective shell extends toward the casting slab and is arranged between two segmented rollers, and the cambered structure of the protective shell conforms to the profiles of the segmented rollers.

Water sealing gaskets are arranged at the connections between both ends of the pair of iron cores and the protective shell.

A electromagnetic stirring method for the secondary cooling zone of slab continuous casting, wherein the method comprises the following steps:

step 1: driving silicon steel sheet group inserts with a cylinder to rotate the same around a movable joint shaft, thus adjusting the opening degree of the closed annular structure, according to the thickness of the casting slab;

step 2: energizing the phase sequence control assembly through the alternating phase conversion circuit so that the electromagnetic coil wound around the iron core produces a periodically alternative magnetic field in the closed annular structure, thus electromagnetically stirring the molten steel in a back-and-forth alternative mode; and step 3: introducing cooling water into the protective shell through the cooling water inlet and completely immersing the electromagnetic coil and the iron core therein, and then spraying the cooling water onto the surface of the casting slab through the multiple cooling water nozzles.

The above said step 2) further comprises the following sub-steps:

step 2.1: turning the first diode of the alternating phase conversion circuit to forwardly conducting state and allowing a commutation current of positive half cycle to pass through the first contactor of the phase sequence control assembly, thus energizing the first contactor to work;

step 2.2: generating a magnetic field with the electromagnetic coil wound around the iron core and connecting the three-phase power supply to the electromagnetic stirring coil with a phase sequence of U-V-W so that the molten steel is subjected to forward electromagnetic stirring;

step 2.3: turning the second diode of the alternating phase conversion circuit to forward conducting state and allowing a commutation current of negative half cycle to pass through the second contactor of the phase sequence control assembly, thus energizing the second contactor to work;

step 2.4: generating a magnetic field with the electromagnetic coil wound around the iron core and connecting the three-phase power supply to the electromagnetic stirring coil with a phase sequence of W-V-U so that the molten steel is subjected to backward electromagnetic stirring; and step 2.5: alternatively turning the first diode and the second diode to conducting state via the alternating voltage of the alternating phase conversion circuit, and alternatively turning the first contactor and the second contactor on/off, thus alternating the phase sequence of the three phase power supply and periodically reversing the electromagnetic stirring direction.

The present disclosure has achieved the following advantageous technical effects over the prior art:

1. The present disclosure comprises a closed annular electromagnetic stirring device to effectively solve the shortcomings of the existing opened stirring device such as large magnetic flux leakage, low stirring efficiency, and the like. Furthermore, the opening degree of the annular electromagnetic stirring device can be adjusted online, hence the electromagnetic stirring effect to the slabs with different thicknesses and magnitudes in the secondary cooling zone can be greatly improved.

2. The present disclosure comprises an automatic control to the phase sequence of the stirring electric current which can achieve a periodic change in the traveling wave electromagnetic stirring direction at a specific frequency, so that the molten steel can be driven by the electromagnetic force to form a horizontal circular flow with alternatively reversed direction, thus solving the problems of the stirring device can only provide stirring effect along one direction and is inapplicable to high-speed continuous casting. The present disclosure enhances and improves the scouring effect of the molten steel on the frontier of the solidification interface, avoids the undesirable influence of long-term scouring effect on the solidification shell derived from the single-direction circulation. Furthermore, the present disclosure can also achieve reduced grain size, increased equiaxed crystal ratio and alleviated center segregation, thus producing a casting slab having improved internal quality and performance properties.

3. The device of the present disclosure further has the advantages of simple structure and diverse functions, is of high value for the application of steel continuous casting, especially high speed continuous casting, and has bright prospect.

Drawing reference signs: 1 casting slab, 2 segmented rollers, 3 protective shell, 4 iron core, 41 grooves, 5 electromagnetic coil, 6 water-cooled cable, 7 cylinder, 8 fixed frame, 9 cooling water inlet, 10 cooling water nozzle, 11 water sealing gasket, 12 movable joint shaft, 13 silicon steel sheet group insert, QS disconnecting switch, FU fuse, KM1 first contactor, KM2 second contactor, FR thermal relay, D1 first diode, D2 second diode, T transformer, R resistor, L1 first agitating current inlet line, L2 second agitating current inlet line, L3 third agitating current inlet line, u1 alternating voltage.

SPECIFIC EMBODIMENTS

The present disclosure will be further illustrated hereafter in conjunction with the drawings and specific embodiments.

Figure 2:
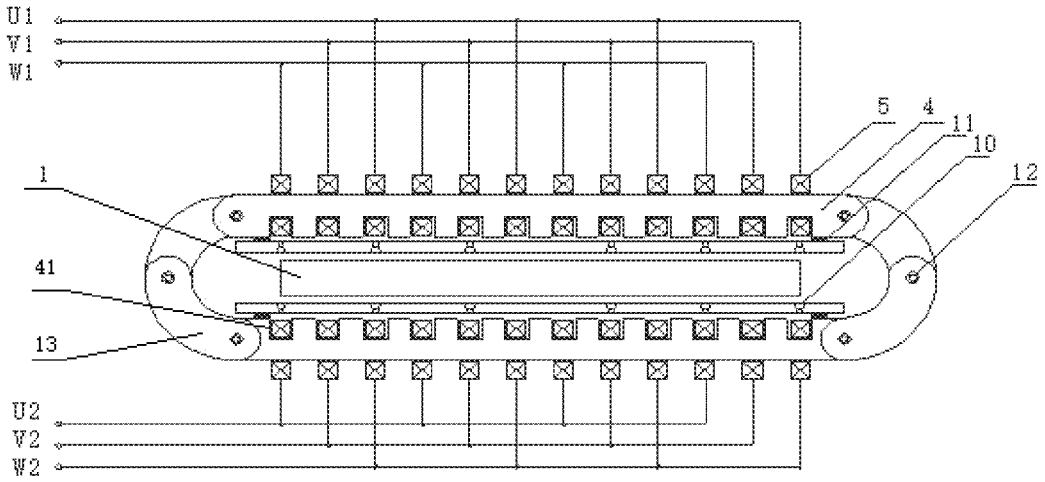
FIG. 2 is a front view of the closed annular structure in the electromagnetic stirring device for the secondary cooling zone of the slab continuous casting according to the present disclosure.
Figure 3:
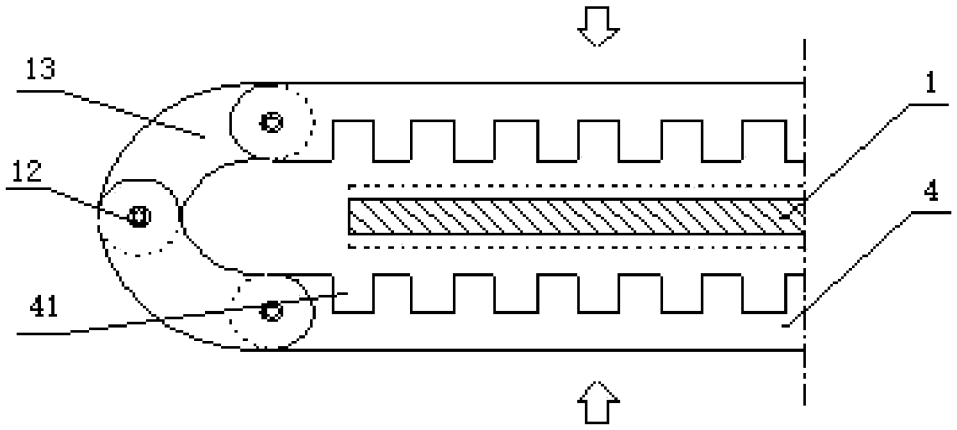
FIG. 3 is a partial enlarged view of FIG. 2.

The present disclosure provides an electromagnetic stirring device for the secondary cooling zone of slab continuous casting, wherein the device comprises an electromagnetic stirring device main body, an opening adjustment assembly and a secondary cooling assembly. As can be seen from FIG. 1 and FIG. 2, the electromagnetic stirring device main body comprises a protective shell 3, a phase sequence control assembly, as well as an iron core 4 and an electromagnetic coil 5 disposed within the protective shell 3. It is shown by FIG. 3 that the opening adjustment assembly comprises a cylinder 7, a fixing base 8, a movable joint shaft 12 and multiple pieces of silicon steel sheet group inserts 13, wherein the multiple pieces of silicon steel sheet group inserts 13 are sequentially connected by the movable joint shaft 12 to form movable joints so that the silicon steel sheet group inserts 13 are rotatable around the movable joint shaft 12. The multiple movable joints are connected with the iron core 4 to form a closed annular structure. Preferably the silicon steel sheet group inserts 13 have cambered structure and can be connected to for cambered movable joints. Three pairs of movable joints can be arranged so that the opening degree of the closed annular structure can be controlled by the rotation of the silicon steel sheet group inserts 13. An electromagnetic coil 5 is wound around the iron core 4, and the electromagnetic coil 5 is operated by the phase sequence control assembly for generating an alternating magnetic field in the closed annular structure. The alternating magnetic field can be efficiently transmitted within the closed annular structure, thus reducing the leakage or loss of the magnetic flux and increasing the electromagnetic stirring efficiency derived from the traveling wave magnetic field. A casting slab 1 passes through the alternating magnetic field in the closed annular structure and incurs the traveling wave electromagnetic stirring action to the molten steel. The cylinder 7, which is fixedly installed on the outside of the electromagnetic stirring device main body through the fixing base 8, has a piston end connected with the electromagnetic stirring device main body and thus providing driven force for the opening and closing of the movable joint. Preferably the cylinder 7 can be configured to have a telescopic structure, e.g. a hydraulic cylinder, which is adaptable for online adjustment of the opening degree of the closed ring structure through telescoping. The secondary cooling assembly comprises a cooling water inlet 9 disposed at an end outside the protective shell 3 and multiple cooling water nozzles 10 spaced apart from each other and disposed at an end inside the protective shell 3 and facing the casting slab 1. Cooling water is transmitted through the cooling water inlet 9 into the protective shell 3 so that the electromagnetic coil 5 and the iron core 4 are completely immersed therein and cooled with the same, and the cooling water is then sprayed onto the surface of the casting slab 1 through the multiple cooling water nozzles 10 for the secondary and supplementary cooling of the casting slab 1. The cooling water flows through the protective shell 3, the iron core 4, the coil 5 and the casting slab 1 in sequence and cools the same. The cooling water flow path is configured to a non-circulating "open circuit" state so as to avoid the interference and influence of the electromagnetic stirring device main body, which is disposed between the segmented rollers 2, on the cooling water nozzles originally exist in the secondary cooling zone, which partially replace the function of the originally existed cooling water nozzles for the secondary cooling of the casting slab.

The alternating magnetic field has a magnetic field strength of 10,000 to 30,000 A·N, preferably 15,000 A·N. Taking into account the effect of drawing speed, the circular flow of molten steel should actually be considered as a spiral pattern, and the increase of the drawing speed will result in a larger pitch of the molten steel flow spiral profile. Therefore, the high-speed continuous casting shall have a properly increased stirring electric current frequency as compared with the traditional electromagnetic stirring. The stirring electric current frequency f1 for the electromagnetic stirring device main body is from 2 Hz to 15 Hz, preferably 8 Hz.

Figure 1:
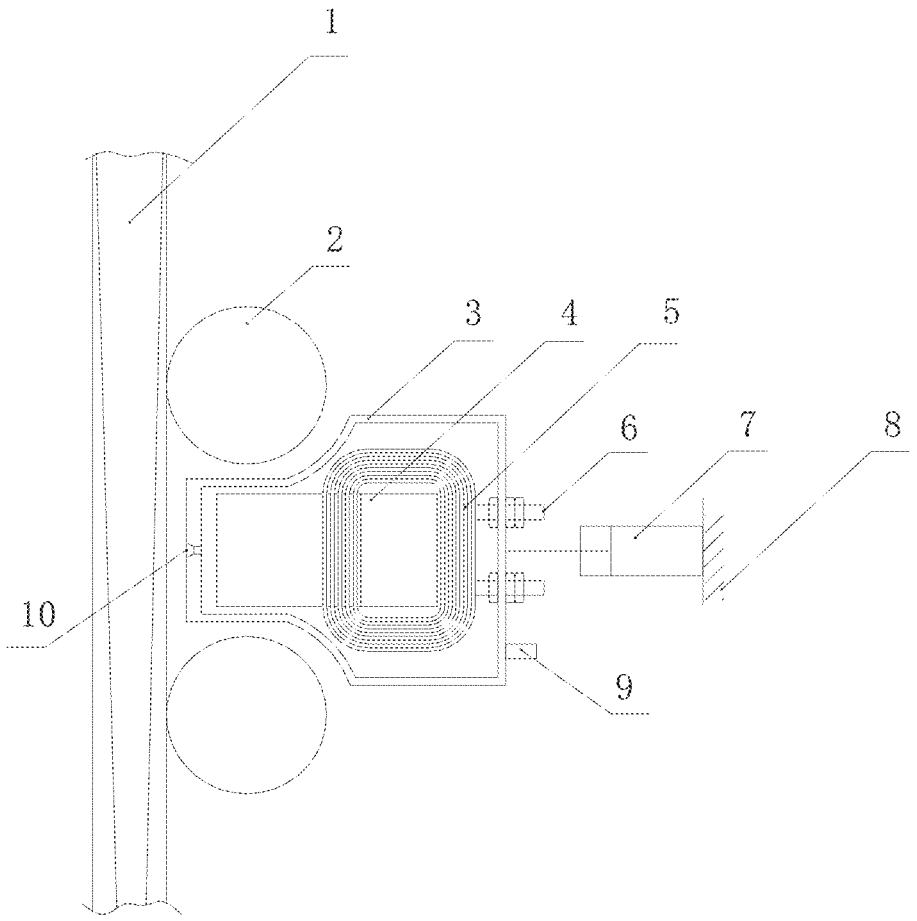
FIG. 1 is a cross-sectional view of the electromagnetic stirring device for the secondary cooling zone of the slab continuous casting according to the present disclosure.
Figure 4:
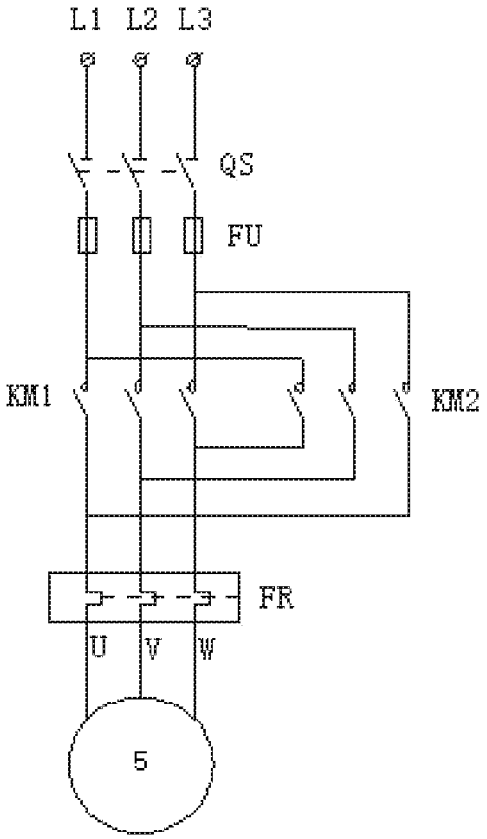
FIG. 4 shows a circuit diagram of the phase sequence control assembly in the electromagnetic stirring device for the secondary cooling zone of the slab continuous casting according to the present disclosure.

As shown by FIGS. 1 and 4, the phase sequence control assembly comprises a water-cooled cable 6, an alternating phase conversion circuit, a fuse FU and a disconnecting switch QS; the water-cooled cable 6 comprises a first stirring current inlet line L1, a second stirring current inlet line L2 and a third stirring current inlet line L3 which are connected to an external three-phase power supply at one end and are connected to the electromagnetic coil 5 via the disconnecting switch QS, the fuse FU and through the alternating phase conversion circuit at the other end.

Figure 5:
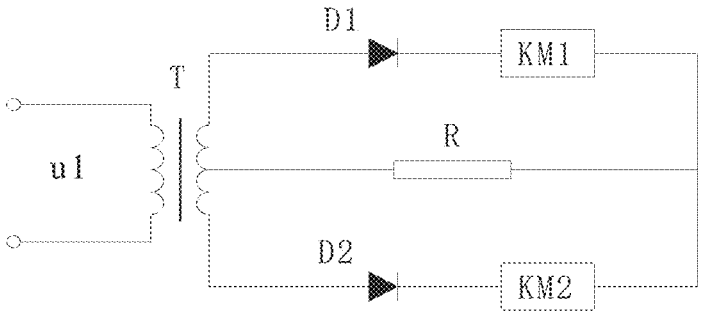
FIG. 5 shows a circuit diagram of the alternating phase conversion circuit in the electromagnetic stirring device for the secondary cooling zone of the slab continuous casting according to the present disclosure.

As shown by FIG. 5, the alternating phase conversion circuit comprises a first contactor KM1, a second contactor KM2, an alternating voltage u1, a transformer T, a first diode D1, a second diode D2 and a resistor R. The anodes of the first diode D1 and the second diode D2 are respectively connected to the secondary output terminal of the transformer T, the cathode of the first diode D1 is connected to the secondary input terminal of the transformer T through the first contactor KM1 and the resistor R, and the cathode of the second diode D2 is connected to the secondary input terminal of the of the transformer T through the second contactor KM2 and the resistor R. The first contactor KM1 and the second contactor KM2 are connected to the electromagnetic coil 5, wherein the phase sequence by which the first contactor KM1 is connected to the electromagnetic coil 5 is reversed to the phase sequence by which the second contactor KM2 is connected to the electromagnetic coil 5, and the on-off of the first contactor KM1 and the second contactor KM2 are respectively controlled by the alternating phase conversion circuit.

The alternating voltage u1 has a frequency f2 of 0.1 Hz to 1 Hz, preferably 0.2 Hz.

The phase sequence control assembly further comprises a thermal relay FR through which the first contactor KM1 and the second contactor KM2 are respectively connected to the electromagnetic coil 5 for overload protection.

As can be seen from FIG. 1, the protective shell 3 comprises a tooth head end concaved inwardly at both sides to form a cambered structure, wherein the tooth head end of the protective shell 3 extends toward the casting slab 1 and is arranged between two segmented rollers 2, and the cambered structure of the protective shell 3 conforms to the profiles of the segmented rollers 2, so that the electromagnetic stirring device main body, especially the magnetic pole head part, can be arranged as close as possible to the surface of the casting slab 1, thus reducing the attenuation and loss of the magnetic field flux in the gap between the electromagnetic stirring device main body and the casting slab 1. Preferably, the protective shell 3 can be made of a non-magnetic stainless steel material, the electromagnetic coil 5 can be prepared by winding a highly conductive copper tube, and the cooling water can further promote the cooling of the electromagnetic coil 5 per se.

The inner side of the iron core 4 is provided with a plurality of grooves 41 at intervals, and the electromagnetic coil 5 is wound in the groove 41 of the iron core 4 to facilitate the uniform distribution of the magnetic field.

Water sealing gaskets are arranged at the connections between both ends of the pair of iron cores 4 and the protective shell 3 to ensure that the cooling water flows within the range of the iron core 4 and the electromagnetic coil 5 without any leakage of water.

Figure 6:
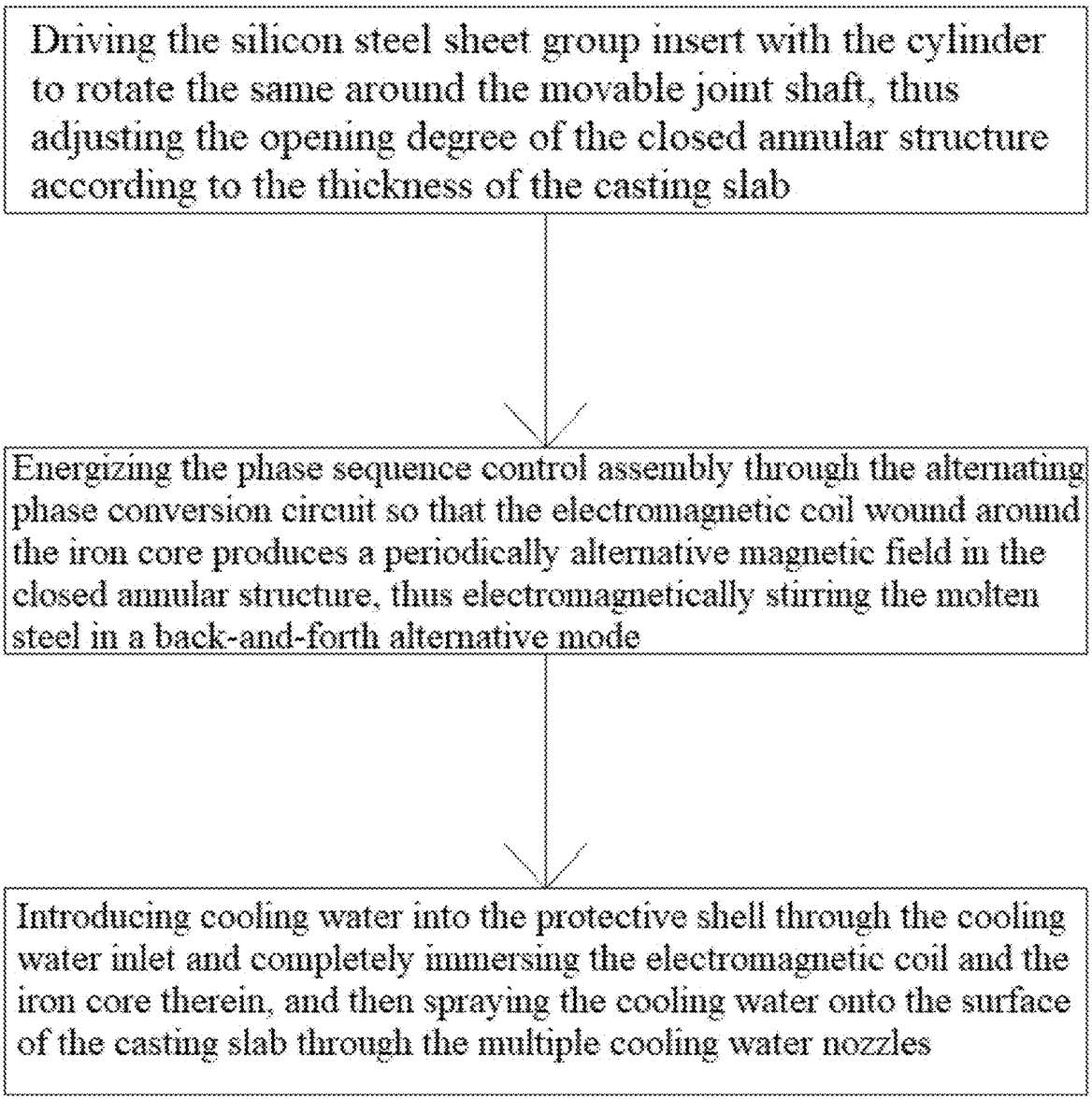
FIG. 6 shows a flow chart of the electromagnetic stirring method for the secondary cooling zone of the slab continuous casting according to the present disclosure.

As shown by FIG. 6, the present disclosure provides an electromagnetic stirring method for the secondary cooling zone of slab continuous casting, wherein the method comprises the following steps:

step 1: driving the silicon steel sheet group insert 13 with the cylinder 7 to rotate the same around the movable joint shaft 12, thus adjusting the opening degree of the closed annular structure according to the thickness of the casting slab 1;

step 2: energizing the phase sequence control assembly through the alternating phase conversion circuit so that the electromagnetic coil 5 wound around the iron core 4 produces a periodically alternative magnetic field in the casting slab, thus electromagnetically stirring the molten steel in a back-and-forth alternative mode; and step 3: introducing cooling water into the protective shell 3 through the cooling water inlet 9 and completely immersing the electromagnetic coil 5 and the iron core 4 therein, and then spraying the cooling water onto the surface of the casting slab 1 through the multiple cooling water nozzles 10.

Step 2.1: turning the first diode D1 to forwardly conducting state and allowing a commutation current of positive half cycle to pass through the first contactor KM1, thus energizing the first contactor KM1 to work.

Step 2.2: generating a magnetic field with the electromagnetic coil 5 wound around the iron core 4 and connecting the three-phase power supply to the electromagnetic stirring coil 5 with a phase sequence of U-V-W so that the molten steel is subjected to forward electromagnetic stirring.

Step 2.3: turning the second diode D2 to forward conducting state and allowing a commutation current of negative half cycle to pass through the second contactor KM2, thus energizing the second contactor KM2 to work.

Step 2.4: generating a magnetic field with the electromagnetic coil 5 wound around the iron core 4 and connecting the three-phase power supply to the electromagnetic stirring coil 5 with a phase sequence of W-V-U so that the molten steel is subjected to backward electromagnetic stirring.

Step 2.5: alternatively turning the first diode D1 and the second diode D2 to conducting state via the alternating voltage u1, alternatively turning on and off the first contactor KM1 and the second contactor KM2, thus alternating the phase sequence of the three phase power supply at a certain frequency and periodically reversing the electromagnetic stirring direction.

EXAMPLE

For the high-speed continuous casting of thin slabs, it is recommended that the electromagnetic stirring device can be installed at the number 0 segment of the segments of the caster sector proximity to the mold outlet. Under the cooling of the cooling water sprayed from the cooling water nozzle in the second cooling zone, the continuous casting slab has a shell thickness of about 10 mm to 20 mm and a non-solidified fraction of 60-80%. The solidified slab shell has already had sufficient strength to withstand the molten steel held within the casting slab 1, thus electromagnetic stirring can be applied from the outside of the wide side without incurring the risk of steel leakage. Furthermore, the liquid core has a large non-solidified fraction, comprises sufficient amount of molten steel, and the growth of columnar crystals has just begun, all of these situations are quite suitable for being subjected to electromagnetic stirring under a certain intensity in the secondary cooling zone. The stirring is conducted by using a electric current intensity of 800 A, and the liquid core within the casting slab 1 is driven alternatively by two electromagnetic forces having identical magnitude and opposite directions generated by the main body of the electromagnetic stirring device to form a horizontal circular flow. Taking into account the influence of drawing speed, the circular flow of molten steel should actually be considered having a spiral profile. Moreover, the increase in the drawing speed will result in increased pitch of the molten steel flow spiral profile. Therefore, the high-speed continuous casting shall have a properly increased stirring electric current frequency as compared with the traditional electromagnetic stirring, such as having a stirring electric current frequency f1 of 8 Hz. When the casting slab is being solidified in the secondary cooling zone, a flow of molten steel is driven by the electromagnetic stirring to continuously scour the dendrites in the crystalline paste zone at the solid/liquid interface frontier within the solidified slab shell, thus constantly breaking the growth of dendrites via a mechanical mechanism, or constantly producing a plurality of new grain growth cores via the necking mechanism of the high-order dendrite roots, so as to produce a final slab 1 having increased equiaxed crystal ratio as well as relieved casting defects such as dendrite segregation, macro-segregation, etc.

In the phase sequence control assembly, the phase sequences of the first stirring current inlet line L1, the second stirring current inlet line L2 and the third stirring current inlet line L3 are automatically switched by contactor controlling means. The contactor is controlled by the internal control circuit thereof. When the electromagnetic coil within the first contactor KM1 is energized (with positive half-cycle control voltage), the coil current will generate a magnetic field which will in turn render the static iron core to generate an electromagnetic attraction force to attract the moving iron core, thus driving the contact action of the first contactor KM1 to connect the three pairs of main contacts and connecting the three-phase power supply to the electromagnetic coil 5 by a phase sequence of U1-V1-W1, so as to electromagnetically stir the molten steel "forwardly". When the electromagnetic coil within the first contactor KM1 is de-energized, the electromagnetic attraction force vanishes. The armature is released by the action of the releasing spring so as to reset the contact and disconnect the main contact of the first contactor KM1. At the same time, the electromagnetic coil within the second contactor KM2 is energized (with negative half-cycle control voltage). The three pairs of main contacts are connected to the main circuit with the aid of electromagnetic attraction according to the same principle, and the three-phase power supply is connected to the electromagnetic coil 5 by a phase sequence of W2-V2-U2, so as to electromagnetically stir the molten steel "backwardly".

The electric on/off control of the electromagnetic coil within the two contactors is achieved by alternating the phase of the alternating voltage u1 having a frequency f2 of 0.1 Hz. When the unidirectional first diode D1 is turned to forward conducting state, the positive half cycle of the commutation current passes through the first contactor KM1, and the first contactor KM1 is energized to operate, thus providing a forward stirring. After forward stirring for 5 seconds, the unidirectional second diode D1 is turned to forward conducting state, through which the negative half-cycle of the commutation current is transmitted to the second contactor KM2, thus the second contactor KM2 is energized to operate, and the phase sequence of the stirring current is automatically switched from U1-V1-W1 to W2-V2-U2. The transmission direction of the traveling wave stirring magnetic field is reversed, which in turn reverses direction of the electromagnetic stirring force inductively generated within the casting slab 1 as well as the molten steel circulation flow direction, thus achieving a backward stirring. After backward stirring for 5 seconds, the electric current is subjected to phase reverse and restored to forward stirring. In the above stated way, the first contactor KM1 and the second contactor KM2 are switched on and off alternately, so that the phase sequence of the three phase stirring electric current is alternated under a specific frequency and in turn the stirring direction is reversed periodically, thus achieving improved scouring effect of the molten steel flow on the solid-liquid interface, enhanced electromagnetic stirring efficiency and avoiding the disadvantages of the ordinary unidirectional stirring technologies.

When the magnitude of the casting slab 1 varies, such as when the thickness of the casting slab 1 is reduced from 80 mm to 60 mm, the movable joint of the electromagnetic stirring device main body is driven by the cylinder 7 disposed at the back side and simultaneously translating the main body of the electromagnetic stirring device toward the width-side of the casting slab 1 for 10 mm; or the movement of only the cylinder 7 on the free side is used to translate the iron core 4 and the electromagnetic coil 5 of the main body of the stirring device at the free side toward the fixed side for 20 mm Both of the above designs will equally result in a reduction of 20 mm in the opening degree of the closed annular structure with the cast slab 1 being kept at the symmetric center of the closed annular structure, thus reducing the loss of the stirring magnetic field flux at the air gap and simultaneously improving the stirring efficiency and effect of the main body of the electromagnetic stirring device in the second cooling zone.

What are illustrated above are merely preferable embodiments of the present disclosure and shall not be interpreted as a limitation to the protection scope of the present disclosure. Therefore, any modifications, equivalent replacements, improvements, etc., made within the spirit and principle of the present disclosure shall be included within the protection scope of the present disclosure.

The invention claimed is:

1. An electromagnetic stirring device for a secondary cooling zone of slab continuous casting comprises comprising a main body, an opening adjustment assembly, and a secondary cooling assembly, wherein the main body of the electromagnetic stirring device comprises a protective shell (3), a phase sequence control assembly, an iron core (4), and an electromagnetic coil (5) disposed within the protective shell (3), the opening adjustment assembly comprises a cylinder (7), a fixing base (8), a movable joint shaft (12) and multiple pieces of silicon steel sheet group inserts (13) that are sequentially connected by the movable joint shaft (12) to form multiple movable joints, wherein the silicon steel sheet group inserts (13) are rotatable around the movable joint shaft (12), and the multiple movable joints are connected with the iron core (4) to form a closed annular structure, wherein an electromagnetic coil (5) is wound on the iron core (4), and the electromagnetic coil (5) is operated by the phase sequence control assembly for generating an alternating magnetic field in a closed annular structure, and a casting slab (1) passes through an alternating magnetic field in the closed annular structure, and wherein the cylinder (7), which is fixedly installed on an outside of the main body of the electromagnetic stirring device through the fixing base, has a piston end connected with the main body of the electromagnetic stirring device and provides a driven force for opening and closing of the multiple movable joints, and the secondary cooling assembly comprises a cooling water inlet (9) disposed at an end outside the protective shell (3) and multiple cooling water nozzles (10) spaced apart from each other and disposed at an end inside the protective shell (3) and facing the casting slab (1), cooling water is transmitted through the cooling water inlet (9) into the protective shell (3), wherein the electromagnetic coil (5) and the iron core (4) are immersed, and the cooling water is sprayed onto a surface of the casting slab (1) through the multiple cooling water nozzles (10).

2. The electromagnetic stirring device of claim 1, wherein the main body of the electromagnetic stirring device is subjected to a stirring current frequency f1 of 2 Hz to 15 Hz.

3. The electromagnetic stirring device of claim 1, wherein the phase sequence control assembly comprises a water-cooled cable (6), an alternating phase conversion circuit, a fuse FU, and a disconnecting switch QS, wherein the water-cooled cable (6) comprises a first stirring current inlet line L1, a second stirring current inlet line L2, and a third stirring current inlet line L3, wherein one end of the first stirring current inlet line L1, one end of the second stirring current inlet line L2, and one end of the third stirring current inlet line L3 are connected to a three-phase power supply, and wherein the other end of the first stirring current inlet line L1, the other end of the second stirring current inlet line L2, and the other end of the third stirring current inlet line L3 are connected to the electromagnetic coil (5) via the disconnecting switch QS and the fuse FU.

4. The electromagnetic stirring device of claim 3, wherein the alternating phase conversion circuit comprises a first contactor KM1, a second contactor KM2, an alternating voltage u1, a transformer T, a first diode D1, a second diode D2, and a resistor R, wherein the alternating voltage u1 is connected to a primary of the transformer T, anodes of the first diode D1 and the second diode D2 are connected to a secondary output terminal of the transformer T, a cathode of the first diode D1 is connected to a secondary input terminal of the transformer T through the first contactor KM1 and the resistor R, and a cathode of the second diode D2 is connected to the secondary input terminal of the transformer T through the second contactor KM2 and the resistor R, the first contactor KM1 and the second contactor KM2 are connected to the electromagnetic coil (5), wherein a phase sequence by which the first contactor KM1 is connected to the electromagnetic coil (5) is reversed to the phase sequence by which the second contactor KM2 is connected to the electromagnetic coil (5), and an on-off of the first contactor KM1 and the second contactor KM2 are controlled by the alternating phase conversion circuit.

5. The electromagnetic stirring device of claim 4, wherein the alternating voltage u1 has a frequency f2 of 0.1 Hz to 1 Hz.

6. The electromagnetic stirring device of claim 3, wherein the phase sequence control assembly further comprises a thermal relay FR through which the first contactor KM1 and the second contactor KM2 are connected to the electromagnetic coil (5).

7. The electromagnetic stirring device of claim 1, wherein the protective shell (3) comprises a tooth head end concaved inwardly at both sides to form cambered structures, wherein the tooth head end of the protective shell (3) extends toward the casting slab (1) and is arranged between two segmented rollers (2), and the cambered structures of the protective shell (3) match profiles of the segmented rollers (2).

8. The electromagnetic stirring device claim 1, characterized in that wherein water sealing gaskets (11) are arranged at connections between both ends of a pair of iron cores (4) and the protective shell (3).

9. A method for electromagnetic stirring with the electromagnetic stirring device of claim 1, wherein the method comprises the following steps:

a) driving the silicon steel sheet group insert (13) with the cylinder (7) to rotate around the movable joint shaft (12) and adjust an opening degree of the closed annular structure according to a thickness of the casting slab (1), b) energizing the phase sequence control assembly through an alternating phase conversion circuit, wherein the electromagnetic coil (5) wound around the iron core (4) produces a periodically alternative magnetic field in the closed annular structure and electromagnetically stir a molten steel in a back-and-forth alternative mode, and c) introducing cooling water into the protective shell (3) through the cooling water inlet (9) and immersing the electromagnetic coil (5) and the iron core (4), and spraying the cooling water onto the surface of the casting slab (1) through the multiple cooling water nozzles (10).

10. The method of claim 9 further comprising the following steps in b):

a) turning a first diode D1 of the alternating phase conversion circuit to a forwardly conducting state and allowing a commutation current of positive half cycle to pass through a first contactor KM1 of the phase sequence control assembly, energizing the first contactor KM1 to work, b) generating a magnetic field with the electromagnetic coil (5) wound around the iron core (4) and connecting a three-phase power supply to the electromagnetic stirring coil (5) with a phase sequence of U-V-W, wherein the molten steel is subjected to forward electromagnetic stirring, c) turning a second diode D2 of the alternating phase conversion circuit to a forward conducting state and allowing a commutation current of negative half cycle to pass through a second contactor KM2 of the phase sequence control assembly, energizing the second contactor KM2 to work, d) generating a magnetic field with the electromagnetic coil (5) wound around the iron core (4) and connecting the three-phase power supply to the electromagnetic stirring coil (5) with a phase sequence of W-V-U, wherein the molten steel is subjected to backward electromagnetic stirring, and e) alternatively turning the first diode D1 and the second diode D2 to a conducting state via an alternating voltage u1 of the alternating phase conversion circuit, alternatively turning on and off the first contactor KM1 and the second contactor KM2, and alternating a phase sequence of the three phase power supply and periodically reversing an electromagnetic stirring direction.

* * * * *